United States Patent [19]

Skatsche et al.

[11] 4,071,008

[45] Jan. 31, 1978

[54] LOW-NOISE-LEVEL INTERNAL COMBUSTION ENGINE

[75] Inventors: Othmar Skatsche; Gerhard Thien; Heinz Fachbach, all of Graz, Austria

[73] Assignee: Hans List, Graz, Austria

[21] Appl. No.: 677,251

[22] Filed: Apr. 15, 1976

[30] Foreign Application Priority Data

Apr. 18, 1975 Austria ..... 3026/75

[51] Int. Cl.[2] ..... F02B 77/00

[52] U.S. Cl. ..... 123/198 E; 181/204; 123/195 C; 123/195 S

[58] Field of Search ..... 123/198 E, 195 C, 195 S; 181/33 K; 64/27 R

[56] References Cited

U.S. PATENT DOCUMENTS

| | | | |
|---|---|---|---|
| 3,464,398 | 9/1969 | Scheiferlein | 123/198 E X |
| 3,524,332 | 8/1970 | Callies | 64/27 R X |
| 3,540,425 | 11/1970 | Scheiterlein et al. | 181/33 K X |
| 3,684,053 | 8/1972 | Fachbach et al. | 123/198 E X |
| 3,808,837 | 5/1974 | Anderson et al. | 64/27 R X |
| 3,924,597 | 12/1975 | Hatz et al. | 123/198 E |

FOREIGN PATENT DOCUMENTS

| | | | |
|---|---|---|---|
| 1,294,101 | 4/1969 | Germany | 123/198 E |
| 1,294,766 | 11/1972 | United Kingdom | 123/198 E |

*Primary Examiner*—Charles J. Myhre
*Assistant Examiner*—Ira S. Lazarus
*Attorney, Agent, or Firm*—Watson, Cole, Grindle & Watson

[57] ABSTRACT

Low-noise-level internal combustion engine with an engine unit support and a cylinder head mounted thereon, auxiliary units rigidly connected to the engine unit support and the cylinder head, an engine case surrounding the engine unit support and connected to same by at least one resonance absorbing member.

15 Claims, 2 Drawing Figures

LOW-NOISE-LEVEL INTERNAL COMBUSTION ENGINE

BACKGROUND OF THE INVENTION

1. Field of the Invention

This invention relates to improvements in low-noise-level internal combustion engines.

2. Description of the Prior Art

It is common knowledge that a very considerable degree of noise abatement can be achieved in internal combustion engines by the provision of outer casings which are secured in a resonance or sound-absorbing manner relative to the engine assembly housed therewithin.

One way in which this can be done is by fitting an existing engine assembly with an outer housing or casing which is not wetted by the oil. However, even the most carefully designed casings of this kind will always add to the weight and volume of the construction, and for this reason their practical application is primarily confined to existing engines of conventional or standard construction.

However, in designing new engines it is advisable to make appropriate provisions from the start for the above-mentioned principle of construction. In an existing arrangement of this kind the conventional closed-side-wall crankcase has been converted into a skeletal type of engine-unit support without side walls in the region of the main bearings, with the major resulting advantage of overall weight reduction. An outer casing which encloses the engine is mounted in an acoustically insulated manner with the aid of individual rubber elements, and the casing comprises two main parts. A lower part has the function of sealing the oil- or sump-area relative to the exterior, whilst the upper part is dry and encases the cylinder head as well as the auxiliary means and devices for the engine, all of which are accommodated in this upper dry area.

In this existing arrangement the lower, oil-wetted part is separated from the dry upper area by means of a resilient seal which encloses the skeletal type engine-unit-support in frame-like manner, and by a rear oil-sump wall with sound-absorbing annular elements inserted therein in the region of the connection for the skeletal engine-unit support and the flywheel casing. The dry enclosed flywheel casing is connected by a flange in conventional manner to a multi-speed gear box which latter, being also subject to resonant vibration from the engine, must of course also be enclosed, or it may be mounted separately from the engine and be driven through a transmission shaft, which naturally increases overall length.

It is the aim of this invention to provide an improvement in internal combustion engines of the kind in which resonance vibrations of the engine parts are not transmitted to the crankcase and the other members connected thereto.

SUMMARY OF THE INVENTION

According to the present invention, I provide a low-noise-level internal combustion engine of the kind having a skeletal support for the crankshaft main bearings and wherein the resonance or vibration generating parts of the engine block, cylinder head and auxiliaries rigidly secured to the cylinder head are connected together, and a composite crankcase and flywheel casing is connected to these parts by at least one resonance-absorbing mounting.

Preferably the composite crankcase and flywheel casing are integral, for example, in the form of a single casting.

The resonance or vibration-generating parts of the engine cannot transmit the vibrations to the composite crankcase and flywheel casing because of the resonance-absorbing mounting. Apart from the advantage of reduced overall weight, this arrangement presents the main advantage that the crankcase and the flywheel casing require no further noise-absorbing provisions whatsoever because all of these parts are already acoustically insulated relative to the skeletal engine-unit support which is itself subject to the operative forces and resulting resonance vibrations.

Preferably the resonance-absorbing mounting provides an oil seal for the crankcase. In this preferred arrangement the mounting comprises an assembly including a continuous resilient/flexible element secured between two frame members, the crankcase and these parts being respectively connected to one frame member.

In the preferred arrangement the upper part of the engine block, the cylinder head and its auxiliaries are enclosed in a non-oil-wetted sound-proofing cover which is also connected to the mounting.

In another arrangement of this invention a sealing element may be provided additional to the resonance-absorbing mounting so as to provide an oil-tight seal between the dry upper region and the lower, oil-wetted region of the engine.

From a design point of view it is particularly advantageous for the effective plane of the resonance-absorbing mounting and, where provided, also of the associated sealing element, to extend above the crankshaft.

The gear box may be connected rigidly to the crankcase or flywheel casing and the crankshaft or flywheel may be connected to the drive shaft by a resilient or flexible clutch. Such a clutch compensates for the relative vibrations of the crankshaft or/and flywheel due to the resilient mounting.

DESCRIPTION OF THE DRAWINGS

An exemplary embodiment of an internal combustion engine according to this invention will now be described with reference to the accompanying drawings wherein.

DESCRIPTION OF THE PREFERRED EMBODIMENT

Figure 1:
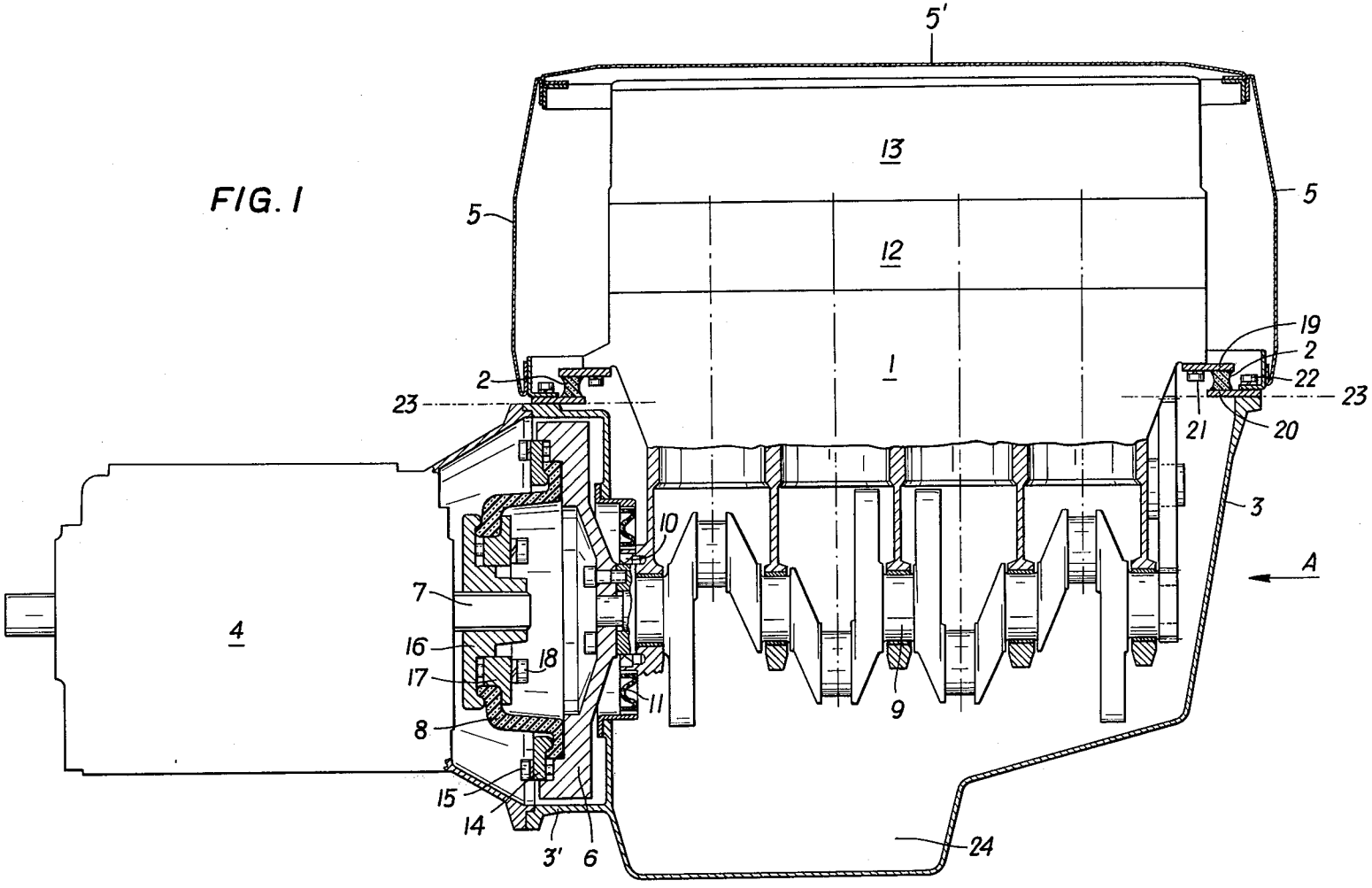
FIG. 1 is a part-sectional longitudinal elevation.

The engine comprises a cylinder block 1, which supports the cylinder head 12 and engine auxiliaries 13, the engine auxiliaries being rigidly secured to the head 12. Both ends of the block provide the skeletal support for the main engine parts. This support can be integral with the block or connected thereto. (For convenience, and since such construction is known, it is herein referred to as the "block"). The cylinder block 1 is mounted on a composite crankcase and flywheel casing 3, 3' by means of a sound or resonance-absorbing mounting. The mounting includes a rectangular metal frame 20 which rests on the upper edge of the crankcase which lies in a plane 23. The frame 20 is connected to the crankcase by bolts 22. A similar rectangular metal frame 19 is secured by bolts 21 to a flange of the block 1. The two frames 19 and 20 partially overlap, and between the overlapping portions there lies a resonance-absorbing or insulating, resilient/flexible element 2. The element 2 is bonded as by vulcanizing or adhesive securing to the frames 19, 20 and extends continuously therebetween. The element 2 also serves as a continuous oil seal between the crankcase 3 and the block 1. The mounting is therefore a compact assembly.

The composite casing 3, 3' is rigidly connected to a gear box 4 by a bolted flange. The cylinder block 1, head 12 and auxiliaries 13 are enclosed an a non-oil wetted sound-proofing cover 5, 5'. The main part 5 of the cover is secured to the crankcase 3 through the frame 20 and the bolts 22. The top of the cover 5' is connected to the main part 5 through an edge frame 25 of angle section.

The cylinder block 1, head 2 and crankshaft 9 are all connected to the crankcase 3 through the resilient element 2 bonded to the frame members 19 and 20 so that during operation of the engine movement relative to the gear box 4 can occur. A flexible rotary coupling 8 is therefore provided between the flywheel 6 and the input drive shaft 7 to the gear box. The flexible rotary coupling 8 is connected to the crankshaft 9 by a clamping ring 14 fastened to flywheel 6 by bolts 15, and is connected to the gear box input drive shaft 7 by a flanged plate 16 comprising a further clamping ring 17 and bolts 18. The amount of relative movement between the main engine structure and the crankcase 3 depends on the softness of the resilient members 2 of the flexible mountings and can be limited by an adequate number of stops on the cylinder block 1 and the engine casing.

In the embodiment as shown one of these stops is formed as a bracket 27 secured to the lower portion 9' of a main bearing of the crankshaft 9 and supporting a rubber buffer 28 mounted on an angular end portion of the bracket 27 by means of a nut 30.

The rear end of the crankshaft 9 extends through an opening in the lower wall of the block 1 and is connected to the flywheel 6. An annular oil seal 10 is mounted in the opening. The sump 24 is sealed by an annular resilient sealing member 11 fitted between the block 1 and the flywheel casing 3' and the crankcase 3.

Figure 2:
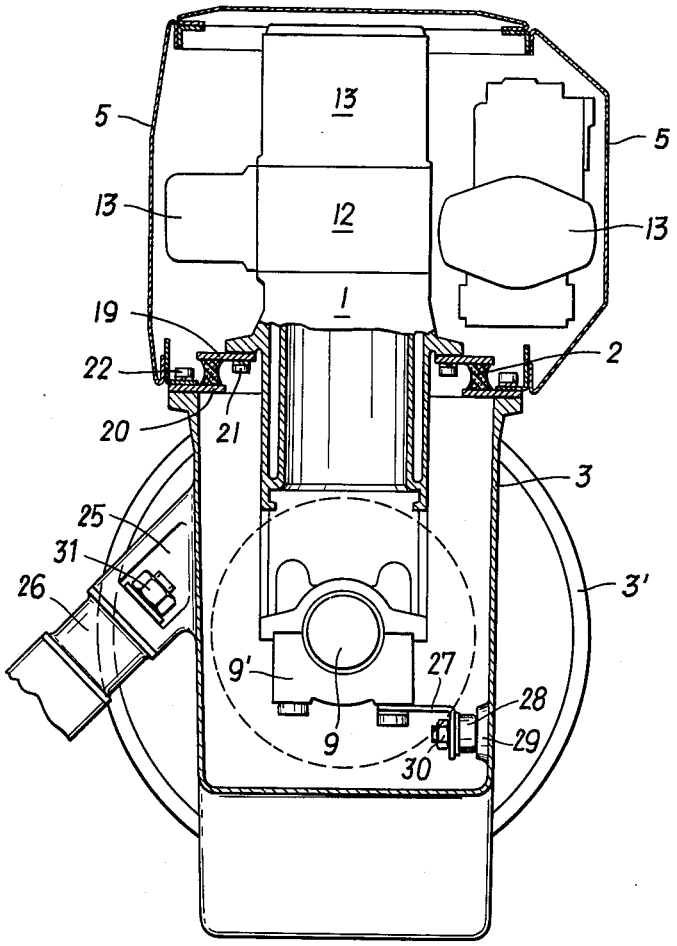
FIG. 2 a part-sectional view in direction of the arrow A of FIG. 1.

With this embodiment, the engine bearings may be arranged in the crankcase 3 as in conventional constructions, as shown on the left side of FIG. 2. The crankcase 3 has laterally protruding supporting brackets 25, each of them supporting a sound-absorbing rubber element 26 secured to the bracket 25 by means of a nut 31. The engine is supported via the rubber elements 26 on a base or vehicle frame (not shown in the drawing) in a manner known per se. On the contrary, in the case of the known prior described constructions wherein the conventional closed-sides crankcase is converted into an open-sided engine-unit support in the region of the main bearings, the engine bearings can only be arranged in the dry upper compartment area since the resiliently mounted oil sump cannot support the operative bearing loads.

The resilient flexible element 2 absorbs resonance and vibrations of the block 1 and the head 2 including the auxiliaries connected thereto so that the vibrations are not transmitted to the crankcase. The movement of the block 1 relative to the crankcase 3, particularly when the engine revolutions pass through a resonating range, may be restricted by providing appropriate stops or abutments.

In an alternative construction (not depicted) the resilient flexible element 2 may comprise a plurality of resilient flexible members like blocks which are spaced around the frame members 19 and 20 and are bonded thereto. In such an alternative construction, the members would not serve as an oil seal and some other oil seal would be required. For instance, a resilient band-like seal could extend between the flange of the block and the crankcase.

I claim:

1. A low-noise-level internal combustion engine comprising a crankshaft and crankshaft main bearings which are engine parts directly affected by body resonance and sound vibration, an engine unit support which supports said crankshaft main bearings, a cylinder head mounted on said engine unit support, auxiliary units rigidly connected to the engine unit support and to the cylinder head, and further comprising a crankcase and a flywheel case connected with the crankcase, and at least one resonance-absorbing member located above the crankshaft between said engine parts which are directly affected by sound vibration and said crankcase and flywheel case.

2. An internal combustion engine according to claim 1, further comprising a sealing element located between said engine parts which are directly affected by sound vibration and said acoustically insulated engine parts, said sealing element dividing the engine into a lower oil-wetted engine region and an encapsulated upper dry engine region which is oil-tightly sealed against said lower engine region by means of said sealing element.

3. An internal combustion engine according to claim 2, wherein said resonance-absorbing member and said sealing element are combined in a single unit.

4. An internal combustion engine according to claim 1, wherein said resonance-absorbing member is located in a plane which is situated above the crankshaft.

5. An internal combustion engine according to claim 1, including a flywheel mounted on one end of said crankshaft within said flywheel case, a gear box rigidly connected to the flywheel case, a gear box drive shaft pivoted in said gear box, a flexible rotary coupling connecting the flywheel to said gear box drive shaft.

6. An internal combustion engine according to claim 5, including means for supporting the engine, said supporting means being secured to said crankcase.

7. An internal combustion engine according to claim 5, including an annular shaft seal fitted in said engine unit support and sealing the crankshaft on its end supporting the flywheel.

8. An internal combustion engine according to claim 5, including an annular elastic sealing element secured on the one hand on said resonance-vibrated engine unit support and on the other hand on said resonance-insulated crankcase on the side of the flywheel case, said annular elastic sealing element sealing the oil-wetted crankcase against the flywheel case.

9. An internal combustion engine according to claim 1, including a sound-proofing casing surrounding said engine parts which are directly affected by sound vibration, said casing being secured to the crankcase and to the flywheel case.

10. An internal combustion engine according to claim 1, including at least one stop provided on said engine unit support and at least one counter-stop mounted on said crankcase and cooperating with said stop of the engine unit support, said stop and counter-stop together limiting relative movement between the engine unit support and the crankcase, particularly when the engine revolves at resonance-revolution numbers.

11. A low-noise-level internal combustion engine which comprises a crankshaft;

a cylinder block;

means in the form of main bearings supporting said crankshaft on and below said cylinder block;

a cylinder head mounted on and above said cylinder block;

auxiliary engine means connected to said cylinder head;

a crankcase mounted to encompase said crankshaft;

a flywheel case connected to said crankcase to form a composite casing;

said composite casing connected to said cylinder block by means of at least one resonance-absorbing member at a point above the level of the crankshaft so as to reduce the transfer of mechanical resonance and sound vibration from the cylinder block to the crankcase and the flywheel case.

12. An internal combustion engine according to claim 11, which includes a flywheel mounted in said flywheel case and connected to an end of said crankshaft which extends into said flywheel case from said crankcase, and an annular sealing means positioned around said end of said crankshaft and sealing said flywheel case from any oil in said crankcase.

13. An internal combustion engine according to claim 11, wherein said at least one resonance-absorbing member extends continuously between said cylinder block and said composite casing.

14. An internal combustion engine according to claim 13, including cover means enclosing a space around said cylinder block, said cylinder head and said auxiliary engine means, means connecting said cover means to said composite casing, said resonance-absorbing member also functioning as an oil seal.

15. An internal combustion engine according to claim 13, wherein a first rectangular metal frame is connected to said composite casing, wherein a second rectangular metal frame is connected to said cylinder block, said first and second metal frames being positioned so as to form an overlap area, and wherein said at least one resonance-absorbing member is positioned between said overlaping area between said first and second metal frames.

* * * * *